US008082678B2

(12) United States Patent
Paruzzolo et al.

(10) Patent No.: US 8,082,678 B2
(45) Date of Patent: Dec. 27, 2011

(54) CLOTHES DRYING MACHINE WITH IMPROVED VAPOUR INJECTION ARRANGEMENT

(75) Inventors: Giovanni Paruzzolo, Giavera del Montello (IT); Silvano Cimetta, Treviso (IT)

(73) Assignee: Electrolux Home Products Corporation N.V., Brussels (BE)

( * ) Notice: Subject to any disclaimer, the term of this patent is extended or adjusted under 35 U.S.C. 154(b) by 325 days.

(21) Appl. No.: 12/526,737

(22) PCT Filed: Feb. 9, 2008

(86) PCT No.: PCT/EP2008/001005

§ 371 (c)(1),
(2), (4) Date: Aug. 11, 2009

(87) PCT Pub. No.: WO2008/098718

PCT Pub. Date: Aug. 21, 2008

(65) Prior Publication Data

US 2010/0107433 A1 May 6, 2010

(30) Foreign Application Priority Data

Feb. 15, 2007 (EP) ..... 07102422

(51) Int. Cl.
*F26B 3/34* (2006.01)

(52) U.S. Cl. ..... 34/73; 34/82; 34/601; 68/5 R; 68/19

(58) Field of Classification Search ..... 34/73, 82, 34/601, 602, 606, 610, 210, 242; 68/5 R, 68/17 R See application file for complete search history.

(56) References Cited

U.S. PATENT DOCUMENTS 2,298,095 A * 10/1942 Dunham ..... 68/12.01
2,724,906 A 11/1955 Pfleider (Continued)

FOREIGN PATENT DOCUMENTS

EP 1 475 474 11/2004
EP 1959048 A1 * 8/2008
GB 2 261 060 5/1993

OTHER PUBLICATIONS

International Search Report and Written Opinion of the International Search Authority mailed Jun. 3, 2008 in corresponding international application PCT/EP2008/001005.

*Primary Examiner* — Stephen M. Gravini
(74) *Attorney, Agent, or Firm* — Banner & Witcoff, Ltd

(57) ABSTRACT

Household-type clothes drying machine provided with a rotating drum (1), first means adapted to circulate a stream of drying air through said drum and comprising an appropriate inflow conduit and an outflow conduit for said air stream, second means (3) adapted to generate a gas or vapour stream, a first delivery pipe conduit (4) connecting said second means with an ejection arrangement located on the inner surface of the loading door of the drum, a second drain pipe conduit (7) adapted to collect the condensed moisture from said ejection arrangement and convey it into a collecting container; said ejection arrangement comprises a substantially sealed cell that is however provided with a first port (9) to enable the gas/vapour stream to flow in from said first delivery pipe conduit, a second port (10) to enable liquid and condensate to flow into said drain pipe conduit, and an ejection window (11) that opens into the interior of said drum and is adapted to eject said gas/vapour stream flowing in from said first delivery pipe conduit. Inside said cell there is provided a vertically extending wall and said first port is oriented towards said wall, which terminates with a free lower, edge projecting onto the bottom of said cell.

11 Claims, 4 Drawing Sheets

U.S. PATENT DOCUMENTS

2008/0295547 A1 12/2008 Finke et al.
2008/0302313 A1 12/2008 Cho
2011/0016928 A1* 1/2011 Beihoff et al. ..... 68/19
2011/0225838 A1* 9/2011 Ahn et al. ..... 34/82

* cited by examiner

CLOTHES DRYING MACHINE WITH IMPROVED VAPOUR INJECTION ARRANGEMENT

BACKGROUND OF THE INVENTION

The present invention relates to an improved kind of clothes drying machine, preferably of the type intended for use in households, adapted to perform operating cycles for handling laundry items loaded in the rotating drum thereof by letting a fluid medium, such as in particular a gas or, still more particularly, steam, i.e. water vapour, or again steam carrying minute particles of condensed water mixed therewith, into said drum holding the laundry items.

While reference will be generally made to a jet of steam in the following description when talking of such fluid or medium due to be injected in the laundry holding drum, this shall in all cases be understood as meaning that such medium may be any fluid mixture—prevailingly in the state of a gas—containing any of a number of other substances, such as detergents, scents, disinfectants, and the like.

Largely known is the possibility for garments and clothes in general, but the most delicate ones in particular, to be submitted to special treatments aimed at freshening them up, i.e. removing creases, wrinkles and felting defects therefrom, wherein such treatments do not involve any traditional washing in water—as followed by machine or air drying—or any dry cleaning process or, finally, any smoothing or flattening with the traditional iron.

In other words, these treatments are carried out by directly loading the clothes to be treated into the rotating drum of a household-type clothes drying machine—generally known as tumble dryer in the art—and then letting a stream of gas or steam, preferably water vapour, into the same drum.

More information and details on such treatments, including the purposes thereof and the manners in which they are carried out, can be inferred from the description given in the European patent application no. 04100490.4 filed by this same Applicant, to which reference is therefore made for reasons of brevity.

Furthermore, a number of solutions and improvements suggesting that some fluids, prevailingly gases and/or vapours, should be let into a container holding garments and clothes items in general to the same purpose of freshening them up or submitting such garments or clothes items to a particular improving treatment, and further enabling such treatments to be effectively carried out, are known from the disclosure in the European patent application no. 0623712.0 filed on Nov. 18$^{th}$, 2006.

Both said patent publications provide a common teaching in that the fluid to be let into the container holding the garments and clothes items to be treated, should be first delivered to a specially provided nozzle opening into the interior of such container, i.e. the dryer drum in the particular case being considered. From such nozzle the fluid is then ejected naturally, owing to the pressure at which it is submitted and supplied thereto, to eventually spread out inside the drum and, as a result, upon and through said garments and clothes items to be treated.

However, these particular manners of carrying out the above-described treatment processes, while inherently simple and effective, have turned out as being peculiar in showing up some practical drawbacks. In other words, they share a peculiarity in that, when said fluid is a gas or vapour mixture that also contains some droplets of a liquid substance, or when the gas/vapour is generated for instance in a rather remotely located boiler and, while flowing through the supply conduit leading it to the drum for injection thereinto, cools down and undergoes partial condensation when reaching the above-mentioned nozzle, it unfailingly occurs that such liquid particles enter the drum as such.

In other words, it quite frequently occurs that issuing from said nozzle there are not only the desired flow of gas/vapour, but also some liquid droplets that are therefore projected into the drum and onto the garments.

The practical drawbacks arising therefrom are of various kinds, i.e.:

1) a first such drawback may for instance arise from the fact that, when the treatment is being carried out on a load of delicate and coloured clothes and garments, which are generally known to have to be handled at temperatures ranging from 40° C. to 60° C. max. when washed and dried, the rather high temperature of approx. 90° C., at which the liquid particles mixed in the vapour steam are ejected from the nozzle, quite often causes the colours of coloured fabrics to suffer alterations, i.e. to discolour in a spot-like, patchy manner; much more apparent and clearly perceived can this problem be, actually, when considering that it quite frequently occurs that the liquid particles being ejected do not involve just some small and sparse droplets, but tend on the contrary to form a real jet of almost entirely liquid medium being sprayed almost continuously and sometimes even abundantly, i.e. in great supply, wherein such circumstance can be most readily be appreciated to be instrumental to aggravating the above-mentioned problem of the spot-like, patchy discoloration of the fabrics;

2) a second drawback is due to the fact that, owing to such treatment being generally carried out following a drying cycle, or being otherwise an isolated process that is carried out independently and, therefore, is not followed by any other treatment, it may well occur that the liquid particles reaching the garments being handled tend to settle thereonto and, while eventually drying up, they nevertheless leave a clearly visible halo-like mark that tend to persist there even after the garments are removed from the drum; the ultimate result is that the treated clothes may eventually take up an appearance that looks even worse than the one they had before being treated for freshening up, wherein quite markedly perceivable are in particular the small spots caused by the aforementioned liquid droplets;

3) a third drawback is in connection with the actual safety of the user of the drying machine: the liquid droplets issuing from the ejection nozzle according to the prior art may in fact keep dripping from said nozzle for a short period of time even after the end of the treatment process, i.e. when the loading door of the machine can be opened so as to enable the user to introduce his/her hands into the drum in view of removing the treated clothes therefrom; in such circumstance, it quite frequently occurs that said droplets fall to hit the hand of the user as it reaches out under the nozzle, and—owing to such droplets being at a temperature of approx. 90° C.—they certainly expose the user to dangerous scalding problems.

SUMMARY OF SELECTED INVENTIVE ASPECTS

It would therefore be desirable, and is a main object of the present invention, actually, to provide a clothes drying machine of the aforementioned kind, which is provided with means for dispersing the gaseous substances that—as mixed with minute liquid fractions—are sprayed into a container, i.e. the rotating drum, in view of carrying out particular processes aimed at treating the clothes and garments loaded in said drum under admission of appropriate fluid substances in the form of gases or vapours, wherein such drying machine is also provided with means adapted to do away with any possibility for not only small liquid droplets, but also even rather copious sprays of liquid mixed with vapour to be able to enter the drum and reach the clothes loaded thereinto jointly with the stream of gas/vapour.

According to the present invention, these aims, along with further ones that will become apparent from the following disclosure, are reached in a clothes dryer incorporating an arrangement for the ejection of fluid substances as defined and recited in the appended claims.

BRIEF DESCRIPTION OF THE DRAWINGS

Features and advantages of the present invention will anyway be more readily understood from the description that is given below by way of non-limiting example with reference to the accompanying drawings, in which.

DETAILED DESCRIPTION OF EXAMPLE EMBODIMENTS

Figure 1:
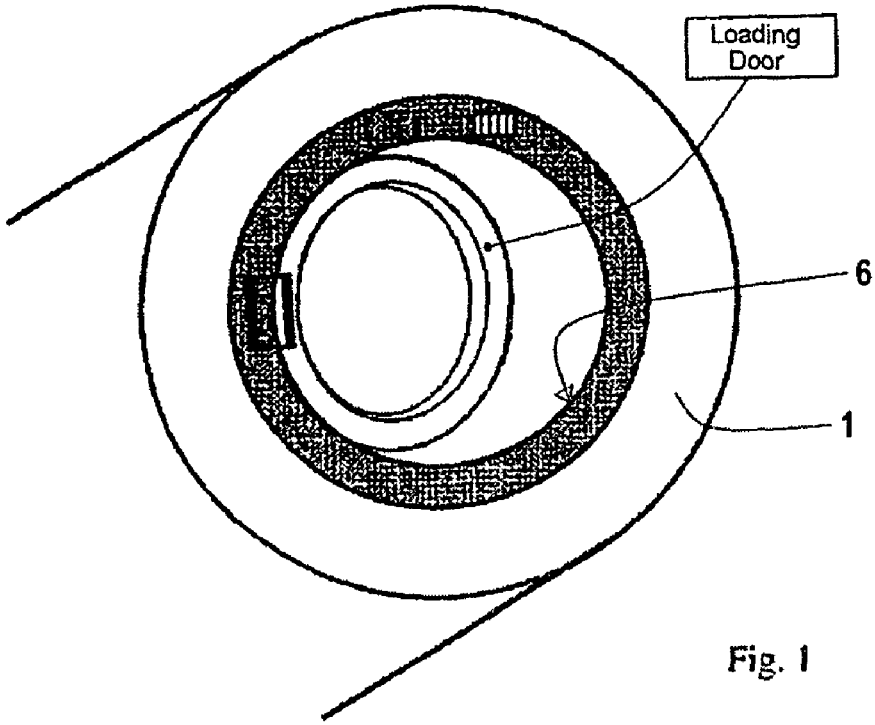
FIG. 1 is a perspective view from the interior of a rotating drum of the loading aperture of the related front-loading clothes drying machine provided with a gas/vapour ejecting arrangement according to the present invention.
Figure 2:
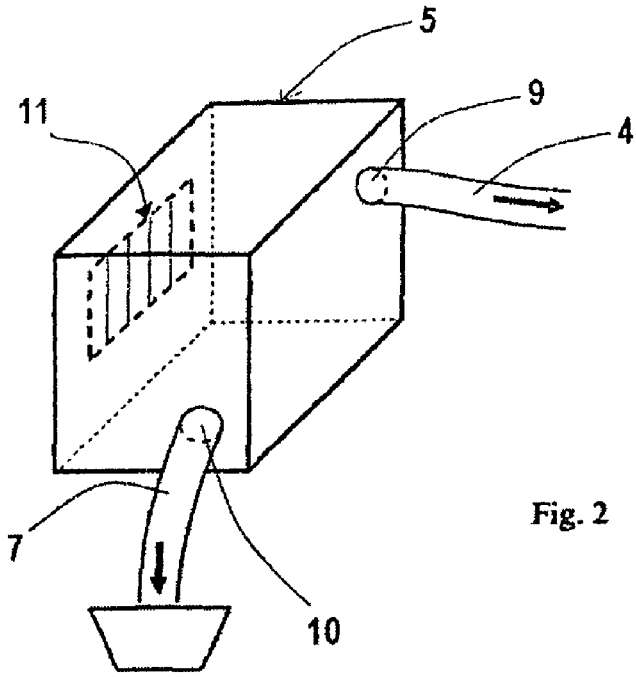
FIG. 2 is a perspective see-through view of a simplified embodiment of the present invention.
Figure 6:
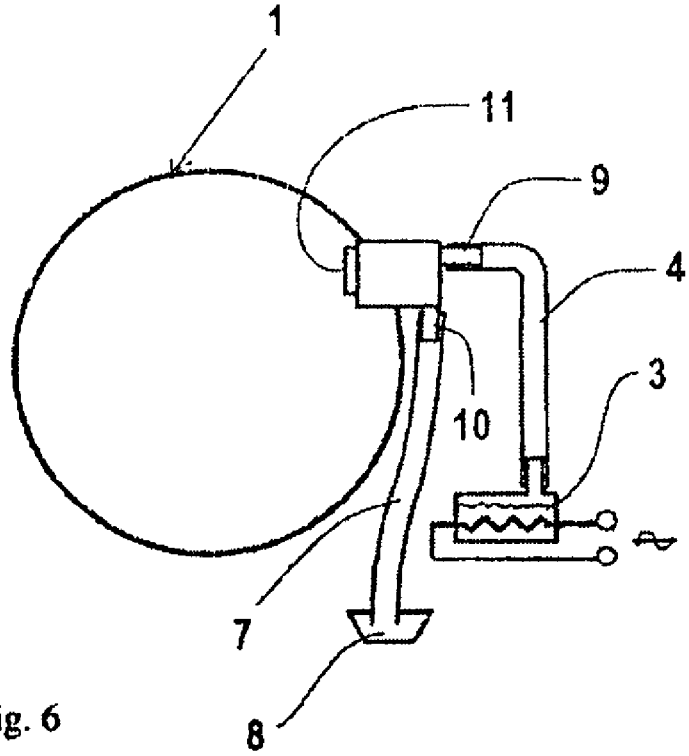
FIG. 6 is a simplified schematics of the steam generator and the related steam supply conduit in a gas/vapour ejection arrangement according to the present invention.

With reference to FIGS. 1, 2 and 6, a clothes drying machine according to the present invention comprises a rotating drum 1 provided to hold the clothes to be dried, across which a stream of hot air is able to flow through a proper conduit generally known as such in the art. The moisture removed from the clothes being dried by said stream of hot air is eventually let out of the drum and off into the outside atmosphere through a second conduit (not shown).

Within the drying machine there is located also a boiler 3 that heats up the water contained therein and—via a first pipe conduit 4—delivers the steam generated by it to a suitably configured ejection cell 5 located inside the same machine in a position close to the inward edge of the loading aperture 6 of the drum, so as to directly communicate with the interior of the same drum.

Branching off from said ejection cell 5 there is a second drain pipe conduit 7, the inflow port of which is configured in a manner so as to be able to collect the liquid droplets and particles that may possibly form in the lower portion of said ejection cell 5, and which leads the so collected liquids into an appropriate collecting container 8.

The above-cited ejection cell 5 can therefore be noticed to be provided with a first outflow port 9, through which the gas/vapour stream enters the cell from said first pipe conduit 4, and a second inflow port 10 that lets into said second drain pipe conduit 7.

In addition, such ejection cell 5 is also provided with a third aperture, which forms an ejection window 11 that is oriented towards and opens into the inner volume of the drum.

Readily appreciated will at this point be the fact that, in a departure from the prior art, in which no element whatsoever is connected between said first delivery pipe conduit 4 and said second drain pipe conduit 7, so that said second inflow port admitting into the drain pipe conduit is capable of collecting just a few ones of the liquid particles that may possibly drip from said first pipe conduit 4, according to the present invention there is on the contrary provided the arrangement of said ejection cell 5, which offers a major advantage in that all liquid particles are effectively intercepted, collected into the bottom portion 14 of the ejection cell 5, and conveyed into said second drain pipe conduit 7.

Furthermore, the present invention allows for some additional advantageous improvements and opportunities.

In this connection, a first improvement is achieved by applying an upright wall 12 inside said ejection cell 5, wherein said upright wall 12 is so oriented as to be facing said first outflow port 9 of the first pipe conduit 4 coming from the boiler 3.

The purpose of said upright wall 12 is to create a partial obstacle aimed at preventing a fully free outflow of the gas/vapour stream flowing out through said first outflow port 9, so that the liquid particles that may be possibly contained in said stream impinge against said upright wall and—coming in this way into contact therewith—are able to settle or condense thereon, and then fall or drip downwards, i.e. towards the bottom portion of said ejection cell 5.

It has furthermore been found that said upright wall 12 performs another useful function, actually. In fact, such wall is normally cold or, anyway, at a temperature that is normally much lower than the temperature of the gas/vapour stream flowing in from said first pipe conduit 4. As a result, when said gas/vapour stream flowing in from said first pipe conduit 4 at a high temperature eventually impinges against said wall, the latter promotes an immediate condensation of the particles in an unstable equilibrium between the liquid state and the gaseous state, so that it practically ensures that the fluid that is ejected into the drum through said window 11, as duly diverted in its flow direction by said upright wall, is in a gas or vapour state in a stable manner, so as to avoid the risk that it may transform, i.e. change into liquid particles when hitting the garments or clothes to be treated.

A second improvement derives from the fact that said upright wall 12 is caused to terminate with a respective lower edge 13 that is free, instead of being connected with the bottom 14 of the ejection cell. This practically enables the gas/vapour stream to pass in a facilitated manner from one side to the other side of the wall 12, since such gas/vapour stream can in this way freely pass through the gap formed between said lower free edge 13 and the bottom 14 of the cell 5.

A third improvement is achieved when said second inflow port admitting into said second drain pipe conduit 7 is substantially arranged and located in the bottom 14 of said ejection cell 5, thereby ensuring that all of the liquid that settles and/or condenses and/or collects onto said bottom 14 is continuously let off therefrom through said drain pipe conduit 7 and into said collecting container 8.

A fourth improvement derives from the fact that arranging said upright wall 12 inside said cell has the practical effect of dividing said cell into two separate chambers 16 and 17. Obviously enough, the first chamber 16 is the one into which there opens said first outflow port 9 of the first pipe conduit 4; in the wall 18 of the second chamber 17 facing the interior of the drum 1, and preferably in the upper portion of said second chamber, there is provided said ejection window 11. In this way, the desired result, i.e. the possibility for the sole gases/vapours duly cleared, i.e. rid of any possible liquid or condensed particles or droplets, which have therefore moved beyond said wall 12 and entered said second chamber 17, to be able to flow into the drum by passing through said window 11, is fully achieved in a quite simple and easy manner.

Figure 7:
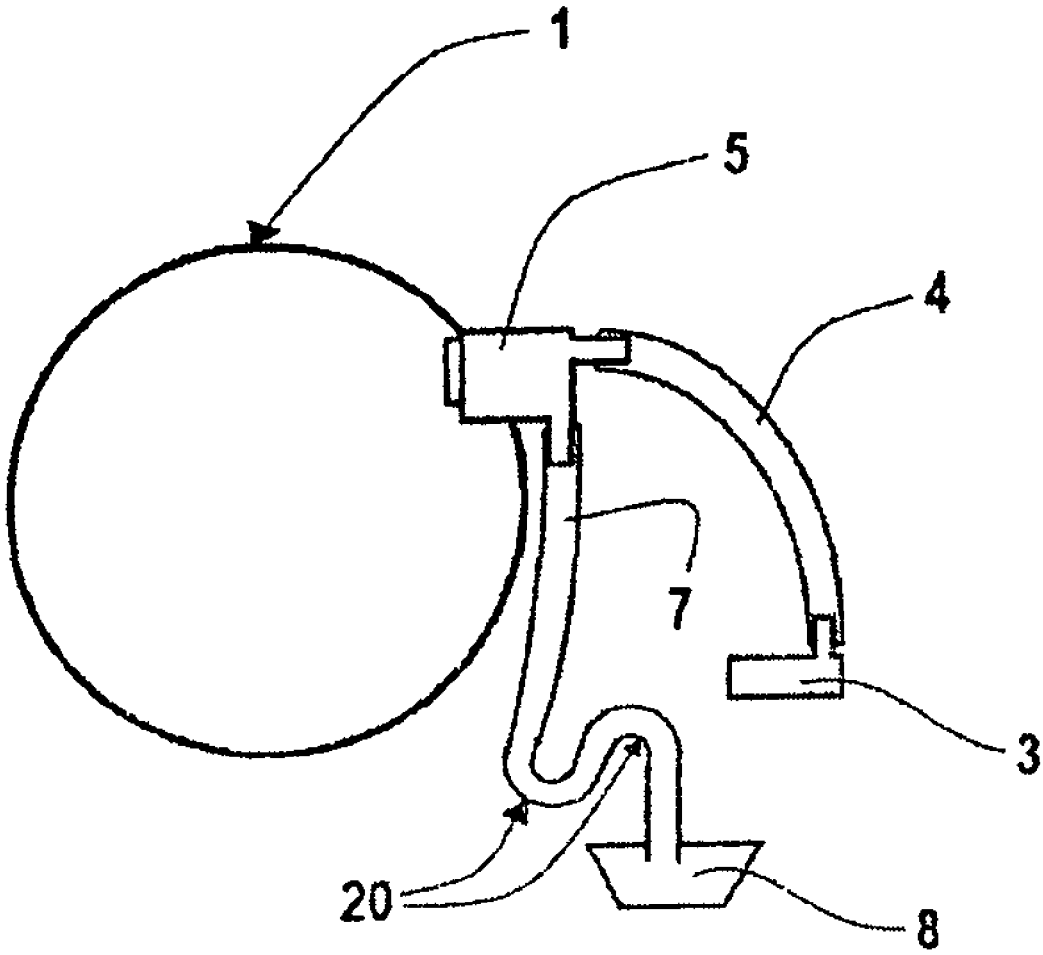
FIG. 7 is a view of a preferred, improved embodiment of a part of the circuit provided to collect intercepted liquid in a clothes drying machine according to the present invention.

With reference to FIG. 7, this illustrates a further improvement yet: in fact, if said drain pipe conduit 7 is allowed to descend freely with a constantly downsloping inclination towards the collecting container 8, a drawback would arise in that the gas/vapour stream issuing from said outflow port 9 into said cell might quite easily escape through said drain pipe conduit 7 instead of flowing into the drum through said ejection window 11.

In view of preventing this possibility from occurring, the drain pipe conduit 7 itself is given such outline, i.e. curvature as to form a siphon-trap 20. In fact, this siphon-like configuration is effective in performing as a seal, which on the one side prevents the gas/vapour stream from escaping through the drain pipe conduit 7 and, on the other side, does not prevent the liquid collecting on the bottom of the cell and flowing into said drain pipe conduit 7 from discharging—albeit at a slower rate (but this is not a problem, nor gives rise to any problem, actually)—into the aforementioned collecting container 8.

Since the gas/vapour stream generated by said boiler 3, and flowing in from said first delivery pipe conduit 4, is at a pressure that is appreciably higher than the atmospheric pressure, a drawback might happen to occur in that, if the cross-section area of the passage aperture of said ejection window 11 is too small, the pressure inside said cell 5 would of course tend to increase to such an extent as to possibly drive the sealing plug in said siphon-trap arrangement too much forward, thereby running the risk of "unplugging" the same arrangement, i.e. nullifying the siphon-trap effect, and enabling the gas/vapour stream to then undesirably escape through the drain pipe conduit 7. As a result, in order to avoid incurring such risk, said window 11 should advantageously be sized so as to be adequately large and wide for it to enable the gas/vapour stream to freely flow therethrough without opposing any detrimental constriction or throttle-like impediment.

Exhaustive laboratory tests have shown that, for it to be able to ensure a satisfactory performance in a household-type clothes drying machine, said ejection window 11 should be given a minimum cross-section area of at least 1.5 $cm^2$.

Figure 3:
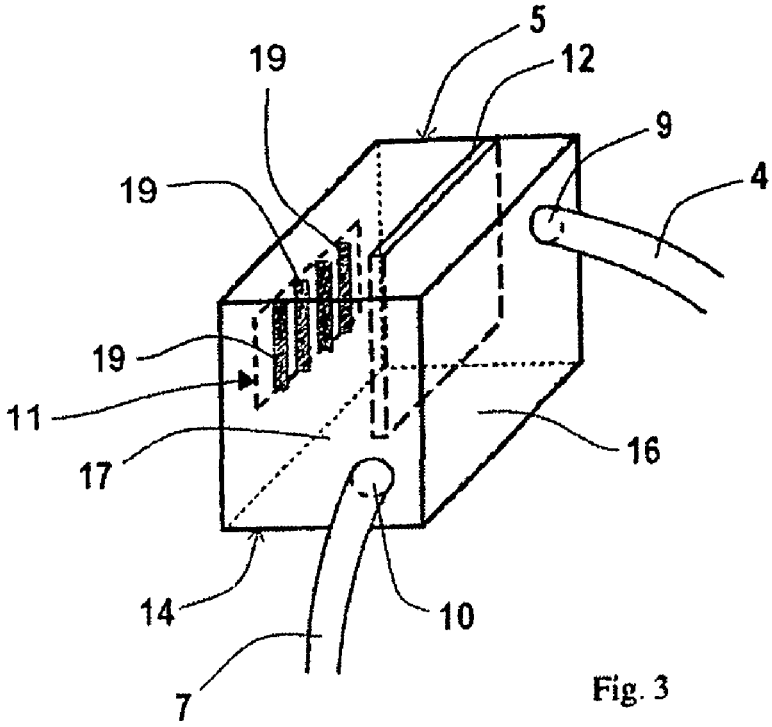
FIG. 3 is a symbolical see-through view of an improved embodiment of the arrangement according to the present invention.
Figure 4:
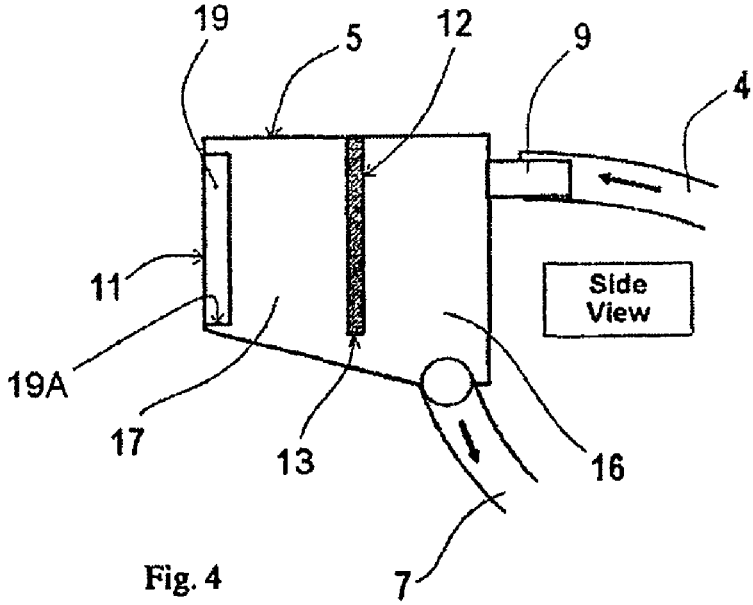
FIGS. 4 and 5 are two respective cross-sectional views, taken orthogonally relative to each other, of the arrangement shown in FIG. 3.
Figure 5:
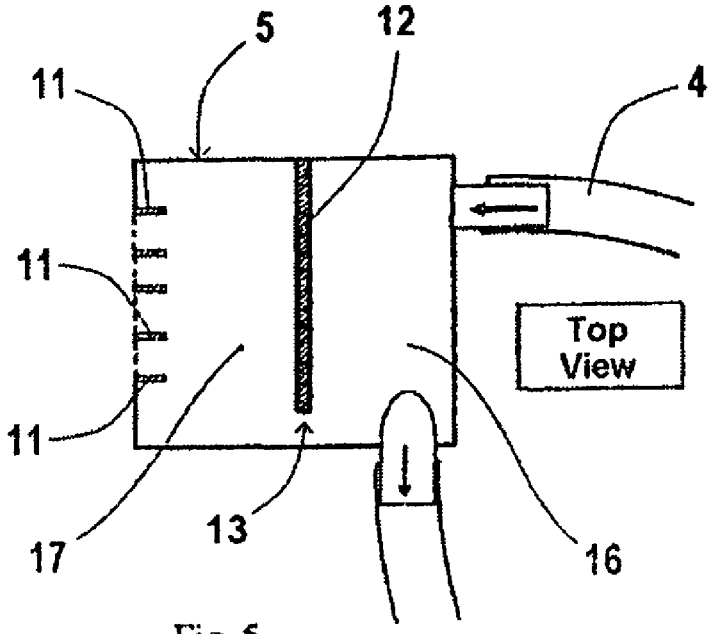

With reference to FIGS. 2 and 3, it can be noticed how a further improvement can now be quite easily obtained in the following manner: in view of favouring an even distribution of the gas/vapour stream from said window 11 towards the interior of the drum and, as a result, towards and upon the clothes being tumbled in said drum, said window 11 is advantageously provided with one or more flow-diverting fins 19 appropriately distributed, sized and spaced from each other across the aperture of said window 11.

In addition, as a further improvement, the lower edge 19A of said flow-diverting fins 19, instead of joining onto the edge of the same window 11, is located inside said second chamber 17. In practice, this improvement enables the fins 19 to be themselves used as an additional wall for intercepting and condensing the stream of saturated vapour and liquid droplets, since these will also impinge against, settle and condense upon said fins 19, thereby enhancing the overall efficiency of the arrangement according to the present invention. Furthermore, by trickling downwards along the fins, the resulting liquid droplets eventually collect and concentrate along said lower edges 19A of the same fins to then naturally fall onto the bottom 14 of the cell 5, from which they are automatically let off through the drain pipe conduit 7 itself.

The invention claimed is:

1. A household-type clothes drying machine comprising:

a rotating drum adapted to hold the clothes and garments to be dried and handled, and provided with a loading aperture, first means adapted to circulate a stream of drying air through said drum and the clothes contained therein, and comprising an appropriate inflow conduit and an appropriate outflow conduit for said air stream, second means adapted to generate a gas/vapour stream, a first delivery pipe conduit connecting said second means with further means provided and adapted to eject said gas/vapour stream towards the interior of said drum, a second drain pipe conduit adapted to collect the condensed moisture from said further means and convey it into a collecting container, characterized in that said further means comprise an ejection cell arranged on an inner surface of said loading aperature of the drum, and oriented towards the interior of the same drum, wherein said cell is substantially sealed, but provided with:

a first port to enable the gas/vapour stream flow in from said first delivery pipe conduit, a second port to enable liquid and condensate to flow into said drain pipe conduit, and an ejection window that opens towards the interior of said drum and is adapted to eject said gas/vapour stream flowing in from said first delivery pipe conduit.

2. A household-type clothes drying machine according to claim 1, characterized in that inside said cell there is provided a wall extending in a substantially vertical manner, and in that said first port is oriented towards said substantially vertical wall.

3. A household-type clothes drying machine according to claim 2, characterized in that said wall terminates with a free lower edge projecting onto the bottom of said cell.

4. A household-type clothes drying machine according to claim 3, characterized in that said second port is substantially located in the bottom of said cell.

5. A household-type clothes drying machine according to claim 4, characterized in that said substantially vertical wall subdivides the interior of said cell into two distinct chambers connected with each other via a passage or gap formed under said free lower edge of said wall; in that said first port opens into a first one of said chambers; and in that said ejection window opens up in the upper portion of a second one of said chambers.

6. A household-type clothes drying machine according to claim 1, characterized in that said ejection window is provided with a plurality of flow-diverting fins adapted to facilitate and promote an even distribution of the gas/vapour stream from said cell towards the interior of said drum.

7. A household-type clothes drying machine according to claim 1, characterized in that said drain pipe conduit is provided, along a section thereof, with a siphon-trap arrangement.

8. A household-type clothes drying machine according to claim 5, characterized in that said ejection window has a cross-section area of a free-passage aperature thereof, of at least 1.5 $cm^2$.

9. A household-type clothes drying machine according to claim 6, characterized in that said flow-diverting fins are provided with respective lower edges, which are located inside said second chamber.

10. A household-type clothes drying machine according to claim 6, characterized in that said ejection window has a cross-section area of a free-passage aperture thereof, of at least 1.5 $cm^2$.

11. A household-type clothes drying machine according to claim 7, characterized in that said ejection window has a cross-section area of a free-passage aperture thereof, of at least 1.5 $cm^2$.

* * * * *